US008281872B2

(12) United States Patent
Duesselberg et al.

(10) Patent No.: US 8,281,872 B2
(45) Date of Patent: Oct. 9, 2012

(54) DRILL HAMMER WITH THREE MODES OF OPERATION

(75) Inventors: Achim Duesselberg, Hangzhou (CN); Andre Ullrich, Filderstadt-Bernhausen (DE); Helmut Heinzelmann, Stuttgart (DE); Thomas Bernhardt, Aichtal-Hroetzingen (DE); Michael Weiss, Stuttgart (DE); Tobias Herr, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 331 days.

(21) Appl. No.: 11/814,411

(22) PCT Filed: Sep. 25, 2006

(86) PCT No.: PCT/EP2006/066679

§ 371 (c)(1),
(2), (4) Date: Jul. 20, 2007

(87) PCT Pub. No.: WO2007/060043

PCT Pub. Date: May 31, 2007

(65) Prior Publication Data

US 2008/0169111 A1 Jul. 17, 2008

(30) Foreign Application Priority Data

Nov. 25, 2005 (DE) ..... 10 2005 056 205

(51) Int. Cl.
*B25D 16/00* (2006.01)
*B25D 11/00* (2006.01)

(52) U.S. Cl. ..... 173/48; 173/109; 173/200; 173/201; 173/210

(58) Field of Classification Search ..... 173/48, 173/109, 200–201, 210
See application file for complete search history.

(56) References Cited

U.S. PATENT DOCUMENTS

| | | | | |
|---|---|---|---|---|
| 4,895,212 | A | 1/1990 | Wache | |
| 5,125,461 | A * | 6/1992 | Hoser | 173/48 |
| 5,320,177 | A * | 6/1994 | Shibata et al. | 173/48 |
| 6,192,996 | B1 | 2/2001 | Sakaguchi et al. | |
| 6,460,627 | B1 * | 10/2002 | Below et al. | 173/48 |

(Continued)

FOREIGN PATENT DOCUMENTS

DE 100 41 410 7/2001

(Continued)

OTHER PUBLICATIONS

JP 2004524168 Published Aug. 12, 2004 (English Abstract Only, With Eng. Equivalent).

*Primary Examiner* — Brian D Nash
*Assistant Examiner* — Michelle Lopez
(74) *Attorney, Agent, or Firm* — Michael J. Striker

(57) ABSTRACT

A drill hammer for the three operation modes of drilling, chiseling, and hammer-drilling has a motor with a motor shaft; a gear with an intermediate shaft, a driving gear wheel, a toothed slaving shaft , a shifting hub, and a driven gear wheel; a percussion mechanism with a wobble disk and a wobble gear wheel; and a driven shaft with a driving gear wheel and a drill chuck. The gear is configured to be changed over easily without axial displacement of running gears that mesh with one another so that the drill hammer is more robust, shorter or more compact, and lighter in weight. The drill hammer is thus simply and economically constructed and whose efficiency is not impaired by the gear shifting mechanism.

11 Claims, 10 Drawing Sheets

U.S. PATENT DOCUMENTS

| | | | | |
|---|---|---|---|---|
| 6,666,284 | B2 * | 12/2003 | Stirm | 173/97 |
| 6,793,023 | B2 | 9/2004 | Holzer | |
| 6,918,450 | B2 * | 7/2005 | Lebisch et al. | 173/104 |
| 6,971,455 | B2 * | 12/2005 | Shibata et al. | 173/48 |
| 7,273,112 | B2 * | 9/2007 | Saur et al. | 173/48 |
| 7,287,600 | B2 * | 10/2007 | Braun | 173/48 |
| 7,306,049 | B2 * | 12/2007 | Soika et al. | 173/49 |
| 7,395,872 | B2 * | 7/2008 | Duesselberg et al. | 173/48 |
| 2007/0102174 | A1 | 5/2007 | Duesselberg et al. | |

FOREIGN PATENT DOCUMENTS

| | | |
|---|---|---|
| EP | 1 157 788 | 11/2001 |
| JP | 61-178107 | 8/1986 |
| JP | 63-237875 | 10/1988 |
| JP | 1-264780 | 10/1989 |
| JP | 6-210507 | 8/1994 |
| JP | 09070771 | 3/1997 |
| JP | 09272005 | 10/1997 |
| WO | 2006/029916 | 3/2006 |

* cited by examiner

DRILL HAMMER WITH THREE MODES OF OPERATION

PRIOR ART

The present application is based on a drill hammer with three modes of operation.

From Japanese Patent Application JP 9-272005, a drill hammer with a changeover mechanism for the three modes of operation of drilling, chiseling, and hammer-drilling is known. The drill hammer has an electric motor, which via a motor pinion meshes with a drive pinion of an intermediate shaft. The drive pinion is seated, in a manner fixed against relative rotation, on the intermediate shaft and transmits the rotary motion of the motor to the intermediate shaft. A toothed slaving shaft is also seated, approximately centrally, on the intermediate shaft in a manner fixed against relative rotation.

A drive bearing for a hammering percussion mechanism is seated, rotatably and rotationally lockably, on the intermediate shaft, axially adjacent to the first side of the toothed slaving shaft. With it, the rotation of the intermediate shaft can be converted into an axial percussion motion of the driven shaft of the drill hammer. The drive bearing is constantly coupled in form-locking fashion to a sleeve that is displaceable axially counter to a spring, and in a terminal displacement position the sleeve is coupled to the toothed slaving shaft, so that as a result, the toothed slaving shaft and the drive bearing as well are in form-locking engagement with one another.

A sliding gear wheel is seated, axially adjacent the second side of the toothed slaving shaft, on the intermediate shaft in rotatable fashion and axially displaceable counter to a spring. This gear wheel is constantly in toothed engagement with an axially parallel driven gear wheel, seated on the hammer barrel in a manner fixed against relative rotation, and is thus also axially displaceable counter to the driven gear wheel.

In a first axial terminal position, close to the toothed slaving shaft, the sliding gear wheel, with an axially protruding set of teeth, is coupled to a corresponding counterpart set of teeth of the toothed slaving shaft in spring-prestressed fashion. The sliding gear wheel transmits the rotation of the toothed slaving shaft, or of the intermediate shaft, to the hammer barrel or to a tool insert secured to it for the drilling or hammer-drilling modes of operation.

In a second axial terminal position, farther from the toothed slaving shaft, the sliding gear wheel is axially released from the coupled position with the toothed slaving shaft by being displaced counter to the tensing force of the spring and is thus rotationally drive-free. This shifting position is intended for the chiseling mode.

The sliding gear wheel has the disadvantage that because of the axial lineup of functional elements and sets of teeth, an increased structural length and hence a greater structural volume and mass are necessary for this construction. In addition, the running gears, meshing with one another, of the sliding gear wheel and hammer barrel gear wheel are under greater stress as a result of the displacement upon changeover of the operating mode than typical running gears, so that their service life is shortened. Moreover, the shifting hub and/or the sliding gear wheel must always be kept by the shifting means in its shifting positions, counter to the prestressing force of the springs, so that as a result of constant axial bracing of the fixed shifting means on the rotating shifting hub and the sliding gear wheel as well as by axial bracing of the prestressed springs on these parts, increased friction is involved, which leads to corresponding heat development, wear, and a reduction in the efficiency of the gear.

DISCLOSURE OF THE INVENTION

The invention has the advantage that the gear can be changed over more easily, and the drill hammer is thus more robust, shorter or more compact, and lighter in weight. The greater robustness of the gear is due to the fact that it makes due without axial displacement of running gears that mesh with one another. A drill hammer is thus created which is simply and economically constructed and whose efficiency is not impaired by the gear shifting mechanism.

Because the intermediate shaft is a simple cylindrical part, on which the driving gear wheel, the slaving gear wheel that in particular is of sintered metal, and the roller bearing are seated in a manner fixed against relative rotation, in particular being pressed on, and these serve as axial securing means for the wobble gear wheel and the driven gear wheel that are freely rotatable on the intermediate shaft, the drill hammer can be produced economically and is robust.

Because each shifting hub has a tooth hub profile, which fits axially displaceably and in a rotationally slaving manner with the toothed slaving shaft, each provided with a toothed shaft profile, the wobble gear wheel and driven gear wheel, the gear is especially easily shiftable.

Because the diameter and the tooth profile of the toothed slaving shaft match those of the adjacent wobble gear wheel and at least a partial region of the driven gearwheel, the individual parts, because they have the same toothing, can be produced economically.

Because the shifting hub is approximately 10 mm wide and hence is approximately half as wide as the toothed slaving shaft, given a compact construction of the gear only a short shifting distance, of approximately 5 mm, is necessary for changing the shifting position.

Because the two shifting hubs, in a center position relative to the toothed slaving shaft, protrude past the toothed slaving shaft by approximately the same length on both sides and are simultaneously in engagement with the adjacent gear wheels, that is, the wobble gear wheel and the driven gear wheel, the shifting position for hammer-drilling is easily adjustable.

Because the shifting hubs embrace the wobble gear wheel and the toothed slaving shaft in a manner fixed against relative rotation and axially displaceably and are displaceable thereon selectively axially to both sides via the adjacent gear wheels, meshing with them in form-locking fashion, so that—in the center position—they are either simultaneously in engagement with the toothed slaving shaft and the wobble gear wheel and the driven gear wheel or, in one of two lateral displacement positions, mesh with either the wobble gear wheel alone or with the driven gear wheel alone, simple changeover of the operating modes of the drill hammer between hammer-drilling, chiseling, and drilling is possible.

Because the shifting hubs, which in particular comprise sintered metal, have an annular-groovelike slot on their outer circumference, for engagement of a gearshift fork serving as a shifting means, simple shifting means for shifting the gear can be used. Because the gearshift forks—except in shifting operations—engage the slot in the shifting hubs without force, in particular in floating fashion and thus with low friction, the friction losses are low and the efficiency of the drill hammer is improved.

Because all the teeth of the toothed shaft profile of the wobble gear wheel and of the driven gear wheel, on their side toward the toothed slaving shaft, each have a partial tooth width reduction, in particular of approximately 1 to 2 mm, which leads to a partial widening of the tooth gaps of the toothed shaft profile that serve as synchronizing recesses—easier changeover and entry of the tooth hub teeth of the shifting hubs into the tooth gaps of the toothed shaft profiles is possible.

Because all the teeth of the shifting hubs, on each of the two face ends, have a partial tooth width reduction of approximately 1 to 2 mm, and the teeth of the toothed shaft profile of the wobble gear wheel and of the driven gear wheel do not have any tooth width reduction, an aid in synchronization is created which is based solely on the design of the shifting sleeve and thus lowers the production cost for the gear.

Because between the motor and the gear, an intermediate flange is seated, in which one end of the intermediate shaft is rotatably supported, in particular via a needle bearing, the housing, which comprises plastic half-shells, is especially secure against deformation and stable. Because a one-piece shift plate, in particular bent into a U, serves as the shifting means, and one of its legs of the U acts as a gearshift fork and its other leg of the U acts as a locking fork, the shifting mechanism can be produced especially simply.

Because the locking fork has a tooth profile with which, particularly in the shifting position of the purely reciprocal motion of the gear, can be put into engagement with the tooth profile of the driven shaft and locks the latter in the process, a changeover of the gear to the chiseling mode, or in other words with a purely reciprocating motion of the gear, is possible with a single, simple machine element, and at the same time the driven shaft is locked in a manner fixed against relative rotation.

Because a shifting spring, embodied as a leg spring, with two shifting legs serves as the shifting means, which independently of one another are adjustable into a plurality of shifting positions and in the process slave shift plates, a simple and robust shifting mechanism is created.

Because the shift plates engage the circumference of the shifting hubs in form-locking fashion and keep them without force in their respective shifting positions by means of the shifting legs, an especially low-friction, long-lived gear with high efficiency is created.

DRAWINGS

The invention is described in further detail below in terms of an exemplary embodiment in conjunction with the drawings.

DESCRIPTION OF THE EXEMPLARY EMBODIMENT

Figure 1:
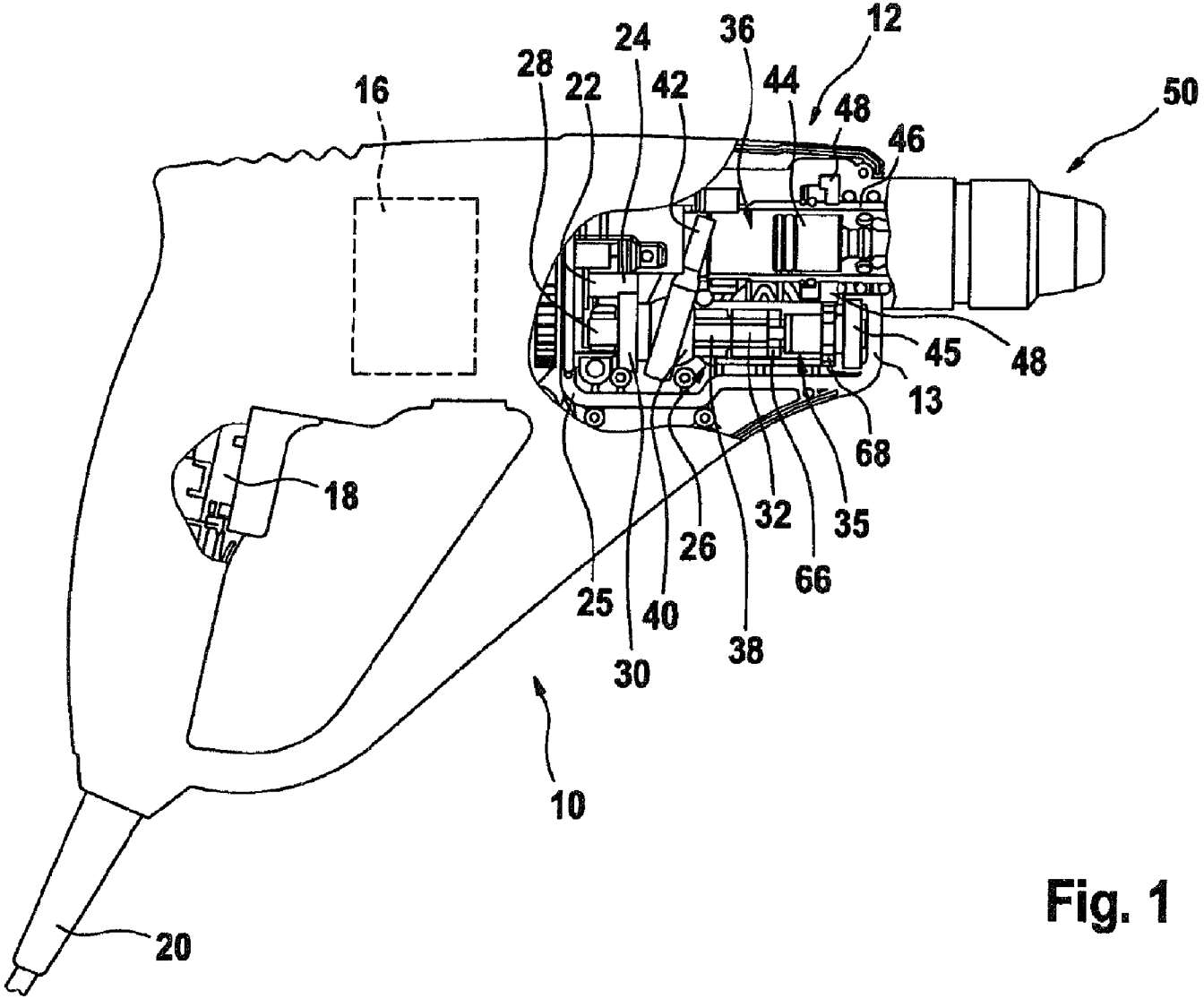
FIG. 1 shows a side view of a drill hammer according to the invention with the housing open.

FIG. 1 shows a drill hammer 10 with a housing 12, which comprises two half-shells 13, 14 of plastic with a vertical parting line, with the upper half-shell 14 removed. The lower half-shell 13 with the functional parts located in it is therefore visible.

The housing 12 receives a motor 16 with an on-off switch 18 and a corresponding power cord 20 for connection to an external source of current, as well as a gear 26 and a percussion mechanism 36. The motor 16 includes a motor shaft 22, whose free end has a motor pinion 24 that is supported in an intermediate flange 25 that can be positionally secured between the half-shells 13, 14. The motor pinion 24 is in engagement with a driving gear wheel 30 of an intermediate shaft 28 of the gear 26 that is supported by one end in the intermediate flange 25, via a needle bearing, not shown. Adjoining this, adjacent to the driving gear wheel 30 that is firmly seated on the intermediate shaft, in particular pressed onto it, a wobble gear wheel 38 is rotatably supported on the intermediate shaft 28. The wobble gear wheel 38 has a wobble disk 40 with wobble fingers 42 as part of the percussion mechanism 36. Axially adjacent to the wobble gear wheel 38, a toothed slaving shaft 32 is supported on the intermediate shaft 28 in a manner fixed against relative rotation, and in particular pressed on. The toothed slaving shaft 32 preferably comprises sintered material and takes the form of a hollow toothed shaft, whose profile extends over its entire external length. The toothed slaving shaft 32 is adjoined axially by a driven gear wheel 35, which is supported rotatably on the intermediate shaft 28 by a needle bearing, not identified by reference numeral.

The driven gear wheel 35 has two different sets of teeth 66, 68. Of these, the first, 66, is located adjacent to the toothed slaving shaft 32 and has the same toothed shaft geometry as the toothed slaving shaft. The second set of teeth 68 is a running gear with the same toothed geometry as an axially parallel driving gear wheel 48, meshing with it, of the driven shaft 46. The intermediate shaft 28 that carries the driven gear wheel 35 is rotatably supported and axially secured in the housing 12 by a roller bearing 45 seated on the outer end, adjacent to the second set of teeth 68.

A first shifting hub 34 is seated axially displaceably, and fitted over it in form-locking fashion, on the first set of teeth 66 of the driven gear wheel 35. In the same way, fitting in form-locking fashion and axially displaceably, a second shifting hub 134 is seated on the wobble gear wheel 30.

The first shifting hub 34, in a first axial shifting position, fits over only the first set of teeth 66 (FIG. 5), and in a second axial shifting position (FIGS. 3, 4), fits over both the first set of teeth 66 and the toothed shaft profile of the toothed slaving shaft 32. Thus in the second shifting position, the driven gear wheel 35 is coupled to the toothed slaving shaft 32 in a manner fixed against relative rotation, while it is released from the toothed slaving shaft in the first shifting position. Consequently, in the first shifting position (FIG. 5)—in contrast to the second shifting position—the rotation of the intermediate shaft 28 that always exists when the motor shaft 24 is rotating is not transmitted to the driven shaft 46. The driven shaft 46 is then stopped for the operating mode of chiseling while the motor 16 is still on.

Figure 3:
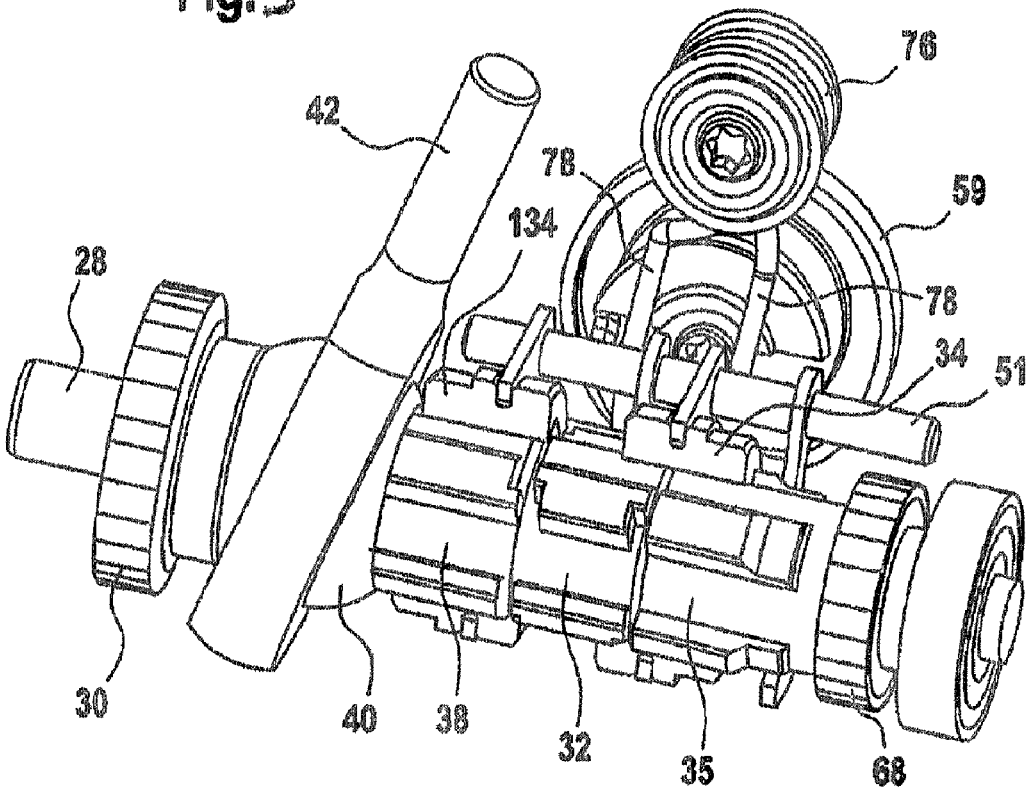
FIG. 3 is a three-dimensional view of the intermediate shaft with gear parts and the changeover mechanism in the hammer-drilling shifting position.
Figure 4:
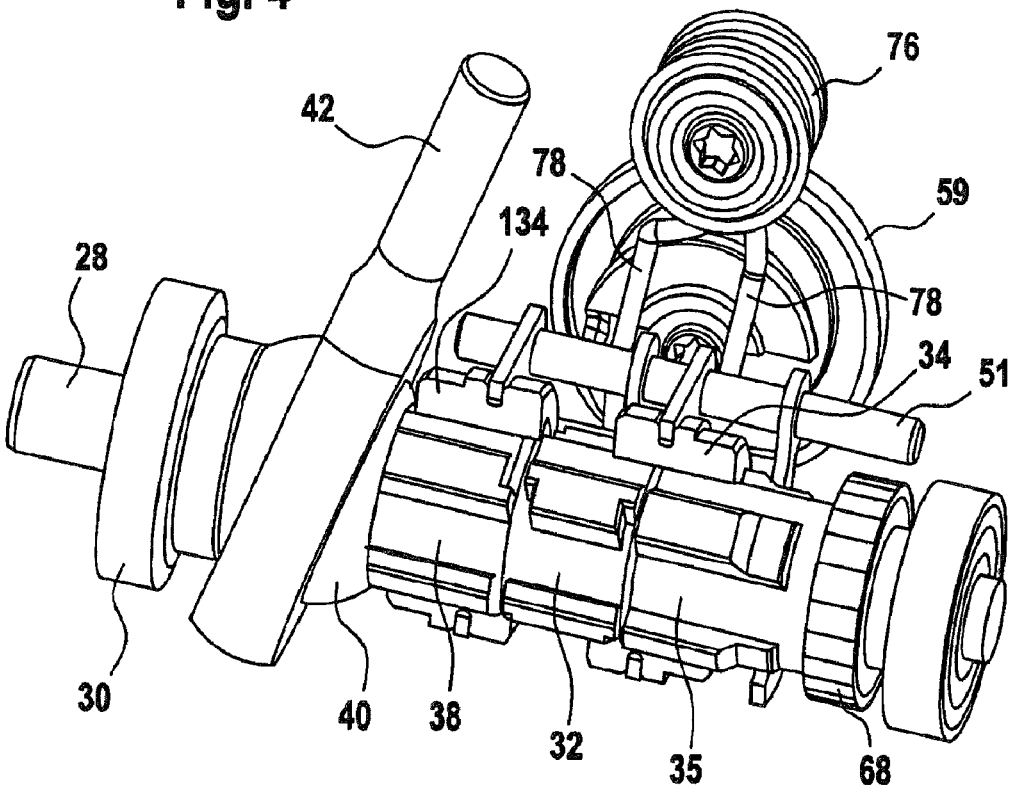
FIG. 4 shows the view of FIG. 3 in the drilling shifting position.
Figure 5:
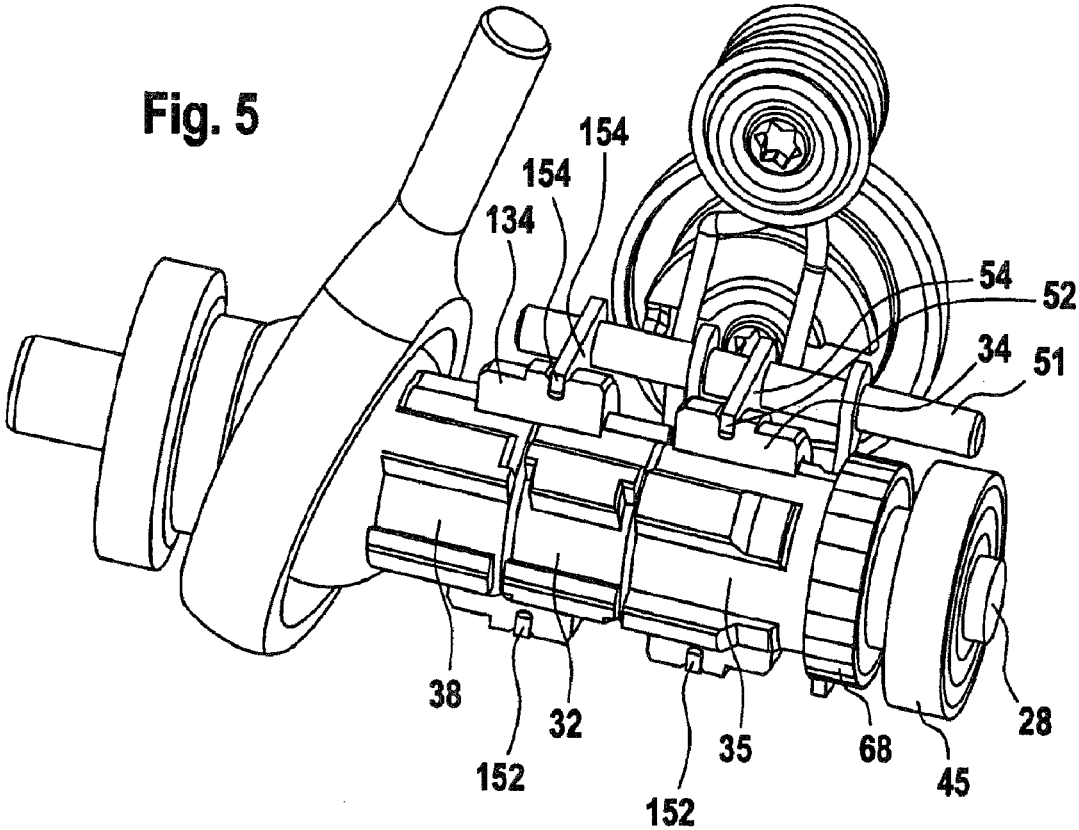
FIG. 5 shows the view of FIG. 3 in the chiseling shifting position.

For chiseling, a second shifting hub 134 must also be displaced from its first shifting position (FIG. 4), in which it fits over only the wobble gear wheel 38, to its second shifting position (FIGS. 3, 5). In its second shifting position, the shifting sleeve 134 fits over both the wobble gear wheel 38 and the toothed slaving shaft 32 and couples them to one another. As a result, the rotary motion of the motor 16 is converted into a reciprocating motion of the percussion mechanism 36. This is necessary both for the chiseling mode (FIG. 5) and for the hammer-drilling mode (FIG. 3). Thus by shifting the second shifting hub 134, it is possible for only the percussion mechanism 36 to be activated or deactivated, without the rotation of the driven shaft 46 being thereby adjustable.

In the drilling mode, the first shifting hub 34 is in engagement with the toothed slaving shaft 32, or in other words in its second shifting position (FIGS. 3, 4). Upon rotation of the motor 16, the driven shaft 46 rotates with it. The second shifting hub 134 must then be out of engagement with the toothed slaving shaft 32, or in other words must be in its first shifting position, in which the percussion mechanism 36 is switched off.

In the hammer-drilling mode (FIG. 3), both shifting hubs 34, 134 are in coupling engagement with both the toothed slaving shaft 32 and the wobble gear wheel 38, or the set of teeth 66 of the driven gear wheel 35. The rotary slaving of the driven shaft 46 and the drive of the percussion mechanism 36 then ensue.

The two shifting hubs 34, 134, with associated shift plates 54, 154, and with a shifting spring 76 coupled to the shift plates 54, 154 and with a shifting cam that actuates the shifting spring 76, form the shifting elements for establishing the three modes of operation, that is, hammer-drilling, drilling, and chiseling.

Adjoining the wobble finger 42, the percussion mechanism 36 continues axially parallel to the intermediate shaft 28 with a percussion element 44. This element transmits percussion energy, which is converted by way of the rotation of the wobble disk 40 into a translational motion of the wobble finger 42, to a percussion part, not identified by reference numeral, in the interior of the driven shaft 46. This percussion part transmits the percussion energy to a drill or chisel, not shown, that is retained in a drill chuck 50.

Both shifting hubs 34, 134, which in operation of the drill hammer 10 rotate, carry a respective annular-groovelike slot 33 on their circumference, for engagement of a respective gearshift fork 52, 152 that is located in a manner fixed against relative rotation. The two gearshift forks 52, 152 are formed from a respective one-piece shift plate 54, 154 (FIGS. 8, 10, 11), bent into a U and having legs of the U 94, 194, 96, 196. The first leg 94, 194 of the U, with a respective semicircular recess 57, 157, forms one gearshift fork 52, 152. Each of the legs of the U 94, 194 and 96, 196 have a respective aligned bore 53 for sliding passage through a guide rod 51.

The second leg 96 of the U of the second shift plate 154 has a tooth profile 58 in a semicircular recess and forms a locking fork 56 for locking engagement with the running gear 68 of the driven gear wheel 35. This engagement is provided in a defined axial position of the gearshift fork 152. The driven gear wheel 35 is thus simultaneously decoupled, by the corresponding position of the shifting hub 34, from its rotary slaving. In this position, the driven shaft 46 is accordingly locked in a manner fixed against relative rotation.

In a defined intermediate position upon shifting from hammer-drilling to the chiseling mode, shortly before the engagement of the locking fork 56 with the running gear 68, the driven gear wheel 35 and thus the driven shaft 46, with the drill chuck and an inserted chisel, are still freely rotatable. The drill chuck 50 and/or chisel can be rotated by hand into a desired working position. In the process, the locking fork 56 does not yet snap into the set of teeth 68 of the driven gear wheel 35, since the shift plate 54 has not yet been displaced into the axial engagement position. This occurs only after the further shifting into the shifting position for chiseling. There, the selected rotary position of the chisel is fixed by way of the rotational locking of the driven shaft 46 by means of the locking fork 56. Locking in a manner fixed against relative rotation of the chisel relative to the housing 12 is thus attained.

The shift plates 54, 154 are supported, axially parallel to the intermediate shaft 28, elastically longitudinally displaceably via a guide rod 51, which for the purpose passes transversely through the legs of the U of the shift plates 54, 154 through the bores 53. For displacement of the shift plates 54, 154 on the guide rod 51 parallel to the intermediate shaft 28, a rotationally actuatable shift button 59 is used, with an eccentric cam 74 that is kept centered between two shifting legs 78 of a shifting spring 76. For that purpose, an angled free end 92 of each of the shifting legs 78 engages a respective slotlike recess 90 in the associated shift plate 54, 154.

Upon rotation of the shift button 59 as indicated by a rotational direction arrow 71, by means of the eccentric cam 74 and depending on the direction of rotation, a respective one of the two shifting legs 78 is pivoted and in the process displaces one of the shift plates 54, 154 linearly along the guide rod 51. In the process, the shifting legs 78 embrace the eccentric cam 74, acting as a shifting device, of the shift button 59 and keep it solidly and centered in overloading fashion in its center position that defines the hammer-drilling mode. The positioning and positional securing of the shifting hubs 34, 134 in their shifting positions is done solely by way of the form locking between the slots 33, 133 and the gearshift forks 52, 152 engaging them and makes prestressed spring elements unnecessary. As a result, in operation of the drill hammer 10, friction losses are avoided, and hence in all three shifting positions, the shifting hubs 34, 134 remain fixed without being subjected to axial force, which leads to reduced wear and a longer service life of the shifting elements.

If upon axial displacement of the shifting hubs 34, 134, their teeth 69 meet the teeth 131 of the corresponding toothed shaft profile 31 of the toothed slaving shaft 32 end-on, then the changeover is facilitated by shifting synchronizing means. To that end, on both face ends of the toothed slaving shaft 32, respective tooth width reductions 62, 64 of approximately ⅔ of the tooth width, over a tooth length of approximately 1 to 2 mm, are employed. The tooth width reduction leads to a partial widening of the tooth gaps of the toothed shaft profile 31 and facilitates the entry of the teeth 69 of the shifting hubs 34, 134 into the tooth gaps between the teeth 37 of the toothed slaving shaft 32. To further improve the synchronization of the shifting of the drill hammer gear 26, the teeth 69 of the shifting hubs 34, 134 may each have a partial tooth width reduction 70 of approximately 1 to 2 mm on the respective face end toward the toothed slaving shaft 32. This facilitates the entry of the teeth 37 of the toothed slaving shaft 32 between the tooth gaps of the teeth 69 of the shifting hubs 34, 134. The function of partial tooth width reductions can also be attained by means of sharpening the face ends of the teeth 69 and 37.

The shifting distance of the shift plates 54, 154 and shifting hubs 34, 134 into and out of their respective shifting positions for a particular mode of operation amounts to a displacement distance of approximately 5 mm each. The angle of rotation of the shift button 59 to the right or to the left is approximately 90° and thus comfortably short.

Figure 2:
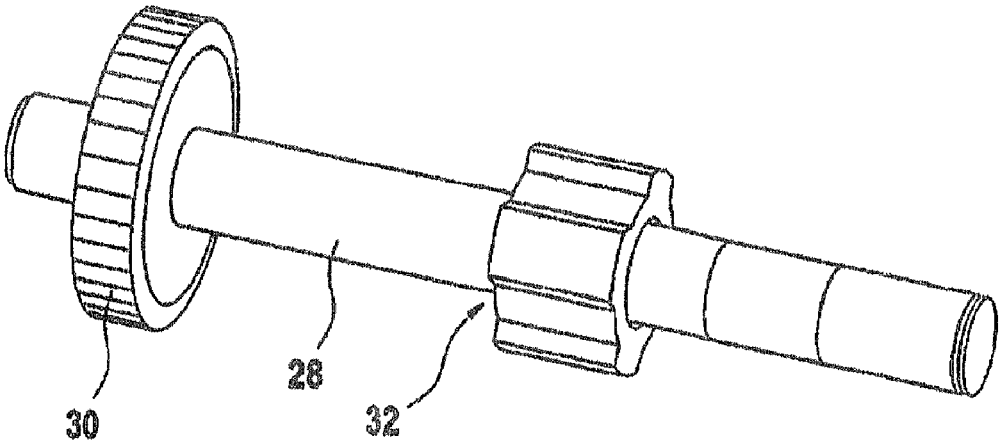
FIG. 2 is a three-dimensional view of the intermediate shaft with the toothed slaving shaft.

The view of the intermediate shaft 28 shown in FIG. 2 makes the corresponding explanations of FIG. 1 clearer.

The three-dimensional view shown in FIGS. 3, 4, 5 of the gear 26 of the drill hammer 10 illustrates the description of FIG. 1 in detail in the hammer-drilling, drilling, and chiseling modes.

Figure 6:
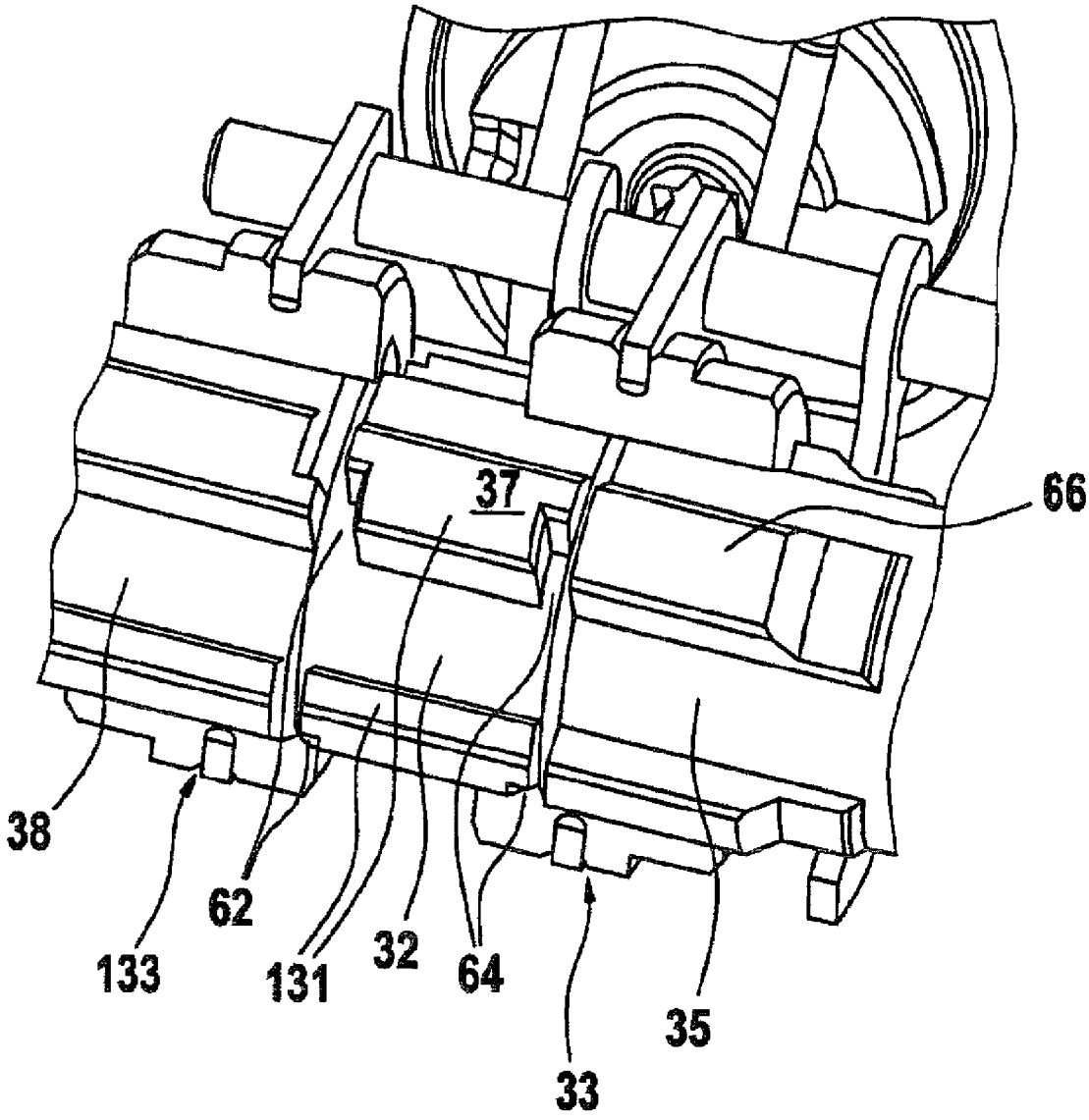
FIG. 6 is an enlarged detail of FIG. 3 looking toward the toothed slaving shaft.

The view in FIG. 6, in an enlarged detail of FIG. 3, shows the gear 26 in the hammer-drilling shifting position.

Figure 7:
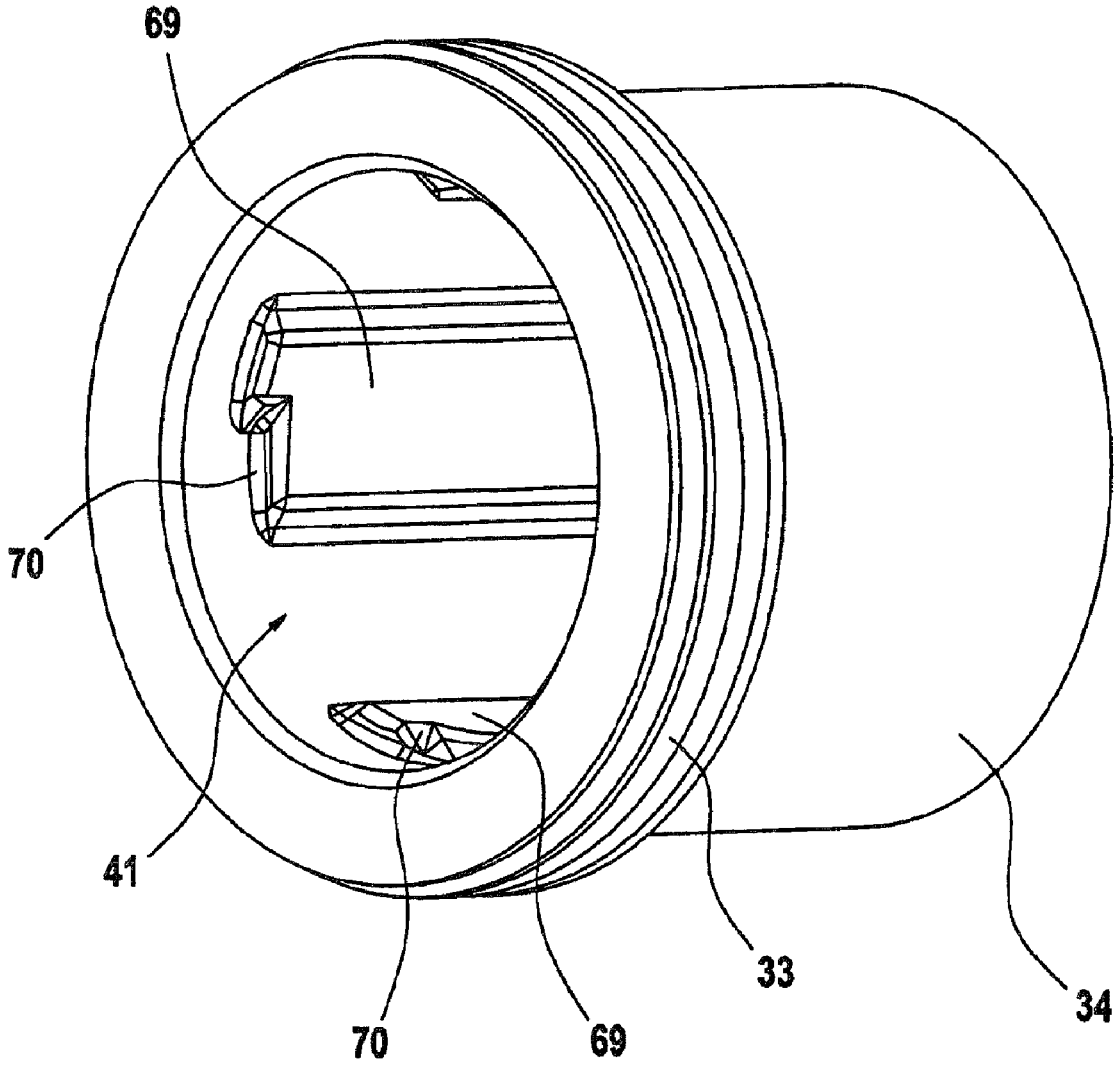
FIG. 7 is a view of one of the two shifting hubs for shifting the modes of operation.

In FIG. 7, a three-dimensional view of the shifting hub 34 shows its design, explained in conjunction with FIG. 1, with the tooth hub profile 29 and the slot 33.

Figure 8:
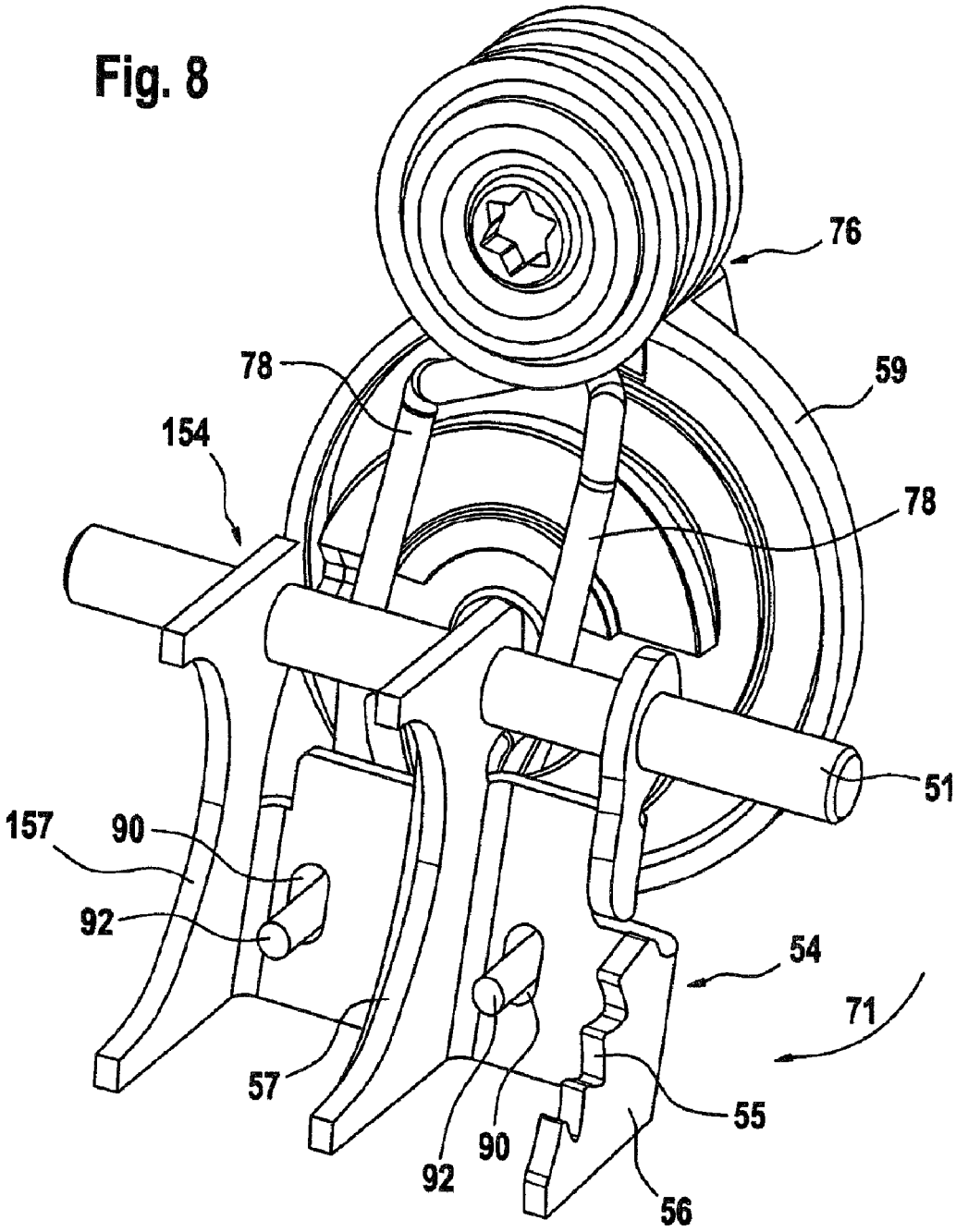
FIG. 8 is a view of the changeover mechanism with shift plates.

FIG. 8 shows a view of the changeover mechanism with shift plates 54, 154, from which the function of the shifting spring 76 with the shifting legs 78 in conjunction with the guide rod 51.

Figure 9:
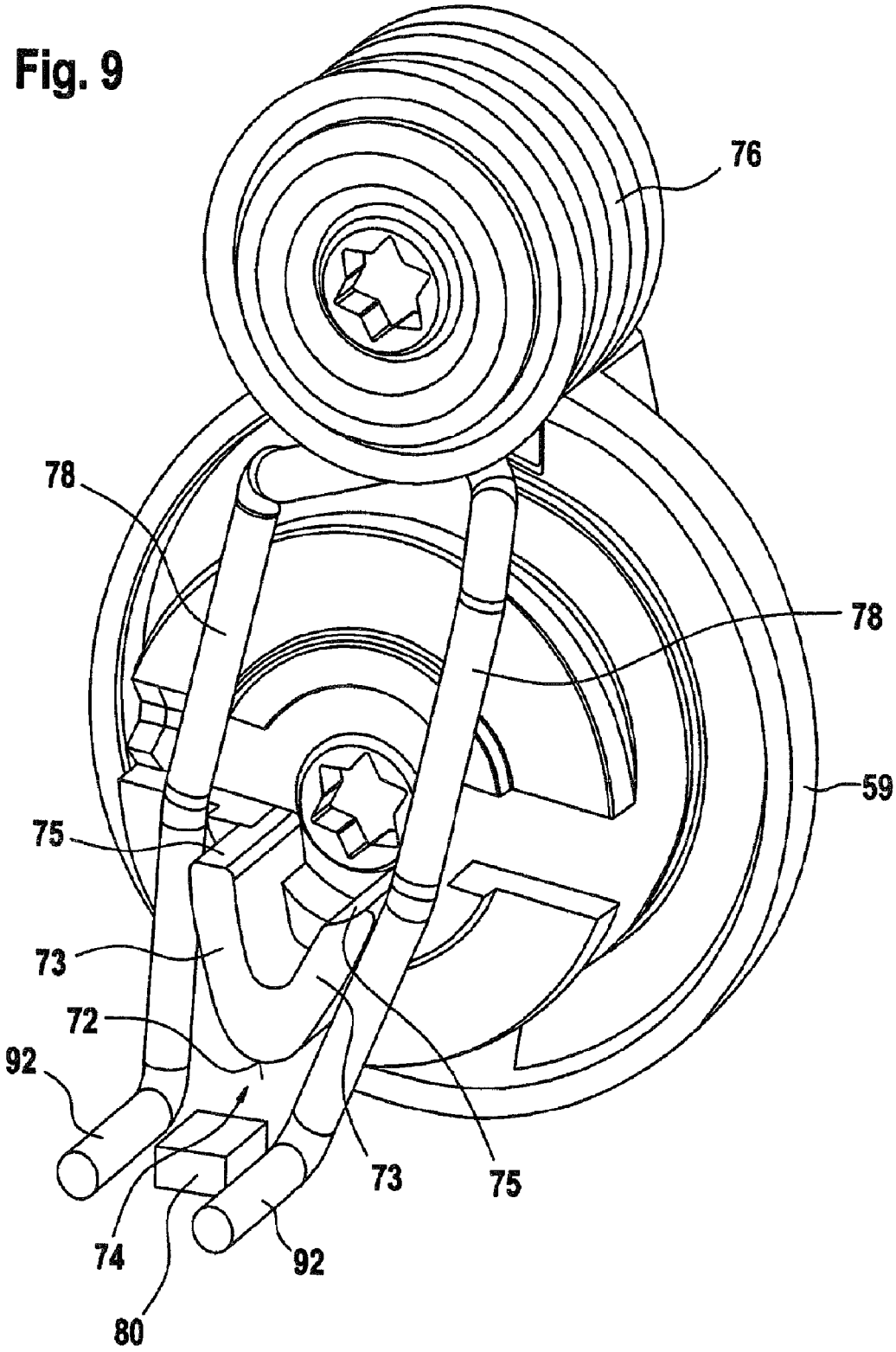
FIG. 9 is a view of the shift button with the shifting leg.

FIG. 9 shows a view of the shift button 59 with the shifting spring 76, which with its angled shifting legs 78 is braced in centering fashion on both sides from outside on the eccentrically located, V-shaped eccentric cam 74. From this drawing, the sequences of motion and function in shifting the modes of operation are shown especially simply. In the center position shown of the eccentric cam 74, the two shifting legs 78 keep the shifting hubs 34, 134 in the position for the hammer-drilling mode of FIGS. 3, 6, and 8, in which the wobble gear wheel 38 and the driven gear wheel 35 are coupled to the toothed slaving shaft 32, and thus the percussion mechanism 36 and the rotary slaving of the driven shaft 46 are selected. If the shift button 59 is rotated clockwise in the viewing direction, the eccentric cam 74 pivots the left shifting leg 78 and the left shifting hub 34 to the left, while the right shifting leg 78 and thus the right shifting hub 134 maintain their position. The drilling mode of FIG. 4 is thus established, in which the wobble gear wheel 38 is decoupled from the toothed slaving shaft 32, and the percussion mechanism 36 is thus switched off.

If the shift button 59 is rotated counterclockwise, then the eccentric cam 74 pivots the right shifting leg 78 and the right shifting hub 134 toward the left, while the left shifting leg 78 and the left shifting hub 134 maintain their position. The chiseling mode of FIG. 5 is thus established, in which the wobble gear wheel 38 is coupled with the toothed slaving shaft 32, and accordingly the percussion mechanism 36 is switched on and the driven gearwheel 35 is rotationally locked; that is, the rotary slaving of the driven shaft 46 is suppressed.

Upon changeover among operating modes, only one of the two shifting legs 78 of the shifting spring 76 is ever moved at a time. So that upon shifting of one shifting leg 78, the other shifting leg 78 will not be actuated and trip an unintentional shifting motion, these legs can be spread only away from one another for execution of the shifting motion, and only as far as the center position, but cannot be moved beyond that toward one another. To that end, the shifting legs 78, in the center position, are braced in prestressed fashion on a center stop 80 structurally connected to the housing and shown only schematically.

Figure 10:
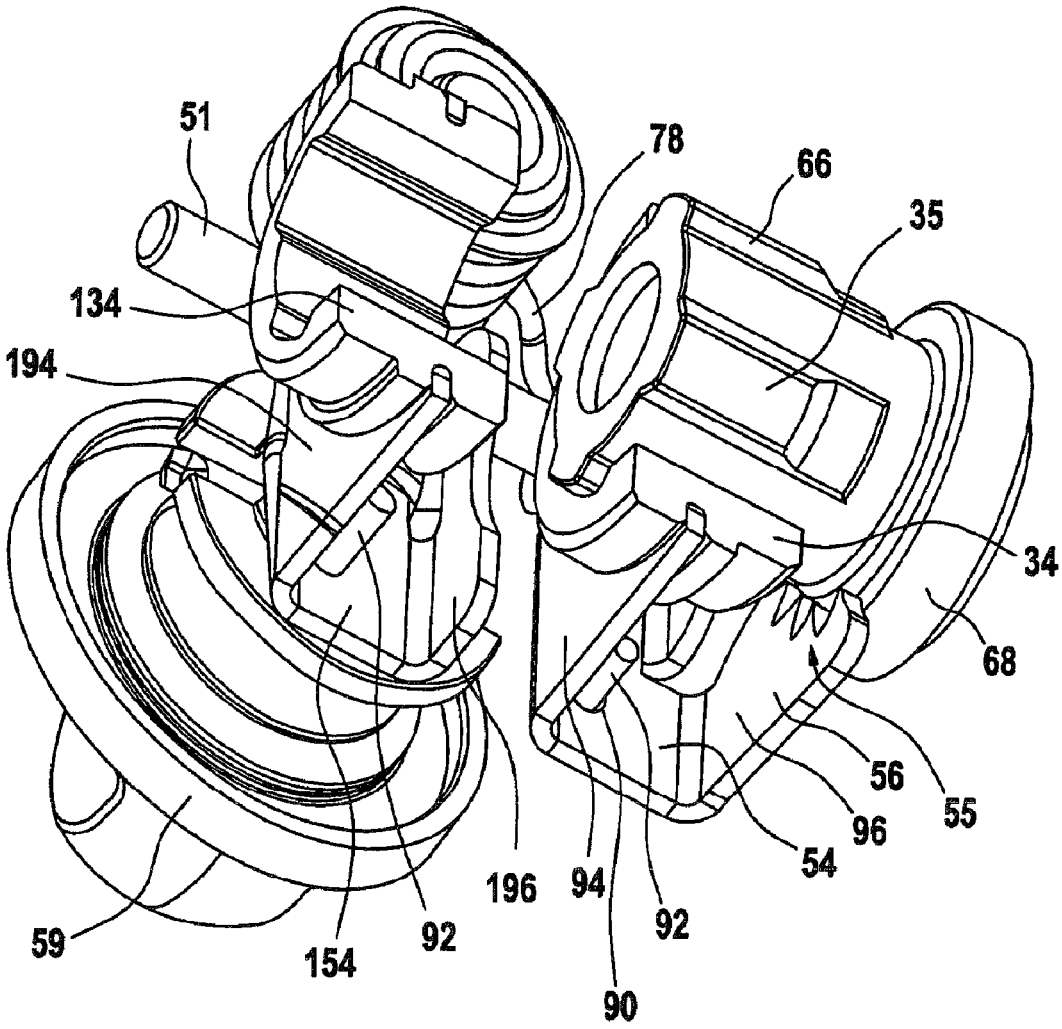
FIG. 10 is a three-dimensional view of the changeover mechanism with shifting hubs, shift plates, and the driven gearwheel.

FIG. 10 shows a three-dimensional view of the shifting elements of FIGS. 3, 4 and 5 from below and behind, making the design and location of the shifting hubs 34, 134, shift plates 54, 154, and driven gear wheel 35, and particularly the design of the locking fork 56 and its association with the running gear 68 in the chiseling position, especially clear.

Figure 11:
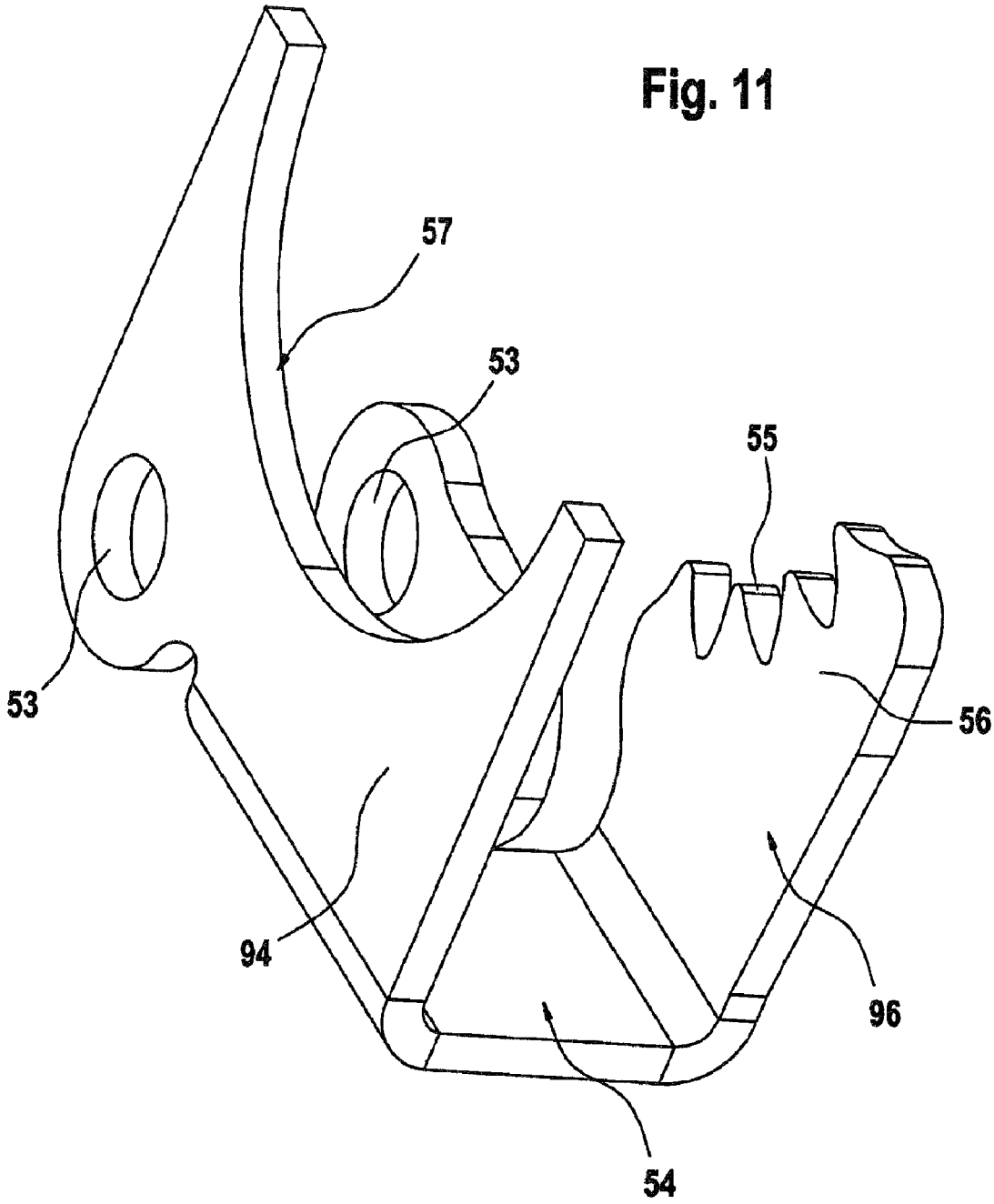
FIG. 11 shows the shift plate for shifting the rotation as a detail.

FIG. 11 shows the shift plate 54 for shifting the rotation of the driven shaft 46 on and off as a detail, in which the locking fork 56 with the counterpart set of teeth 55 for the running gear 68 is especially clear.

Figure 12:
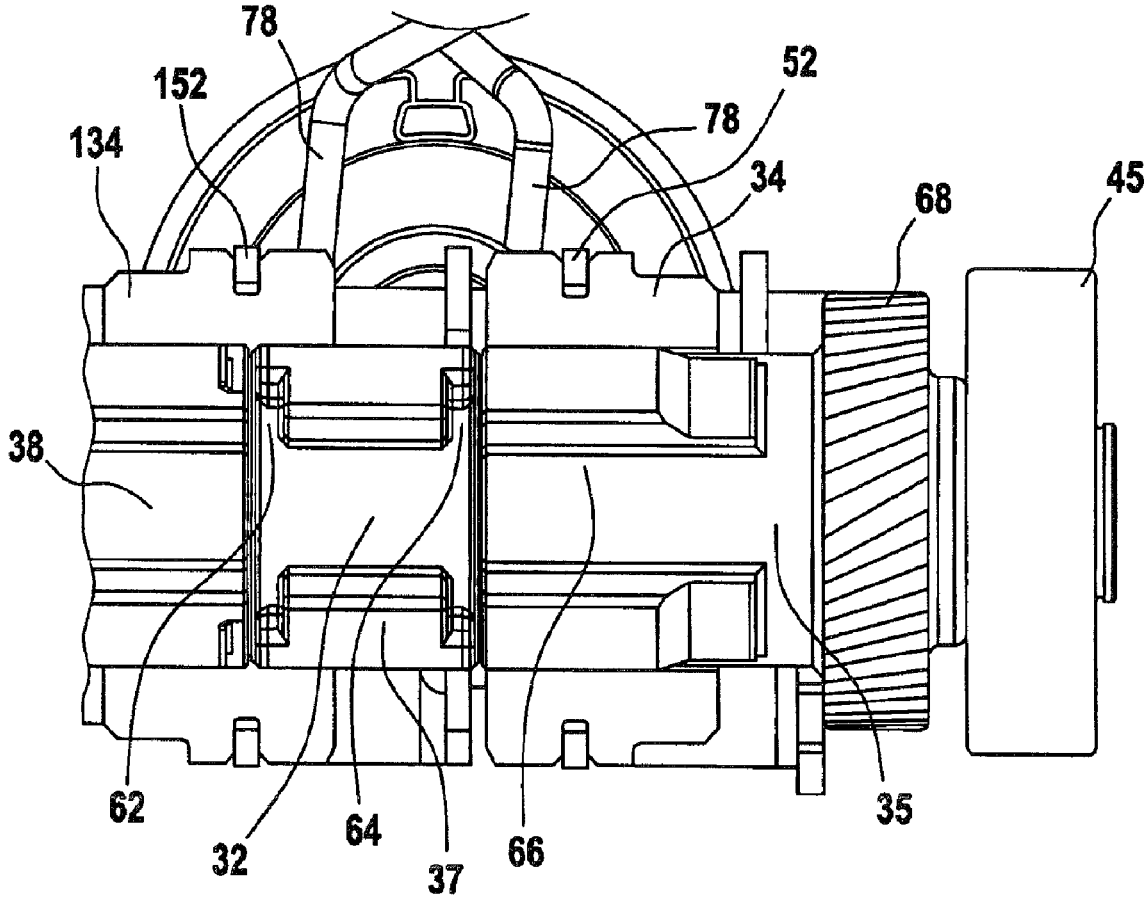
FIG. 12 shows the gear of FIG. 3 in a defined intermediate shifting position for rotary positioning of a chisel for the chiseling mode to be set thereafter.

FIG. 12 shows the gear of FIG. 3 in an intermediate shifting position, located between the terminal positions for chiseling and hammer-drilling, for rotational positioning of a chisel shortly before the locking fork 56, on its further axial displacement course, with its counterpart set of teeth 55 meshes with the running gear 68 of the driven gear wheel 35 and firmly restrains the latter.

The invention claimed is:

1. A drill hammer (10), comprising:

a housing (12);

a motor (16);

a gear (26) having an intermediate shaft (28), a driving gear wheel (30), a toothed slaving shaft (32), a first shifting hub (34), a second shifting hub (134), and a driven gear wheel (35);

a percussion mechanism (36) having a wobble disk (40) and a wobble gear wheel (38); and a driven shaft (46) having another driving gear wheel (48) and a drill chuck (50), wherein the driven gear wheel is freely rotatable without axial displacement on the intermediate shaft, wherein the toothed slaving shaft is supported without axial displacement on the intermediate shaft, and wherein the drill hammer, by a power train from the motor to the drill chuck via a combination of the gear, the percussion mechanism, and the driven shaft, with the first and second shifting hubs, arranged separately at opposing sides of toothed slaving shaft (32) and, independently shifted at a plurality of predetermined shifting positions with respect to the toothed slaving shaft (32), has three operation modes including a chiseling mode, a drilling mode, and a hammer-drilling mode, in the chiseling mode the drill chuck being in a purely axial reciprocating motion, in the drilling mode the drill chuck in a purely rotating motion, in the hammer-drilling mode the drill chuck in a combined axial reciprocating and rotating motion.

2. The drill hammer as defined by claim 1, characterized in that the intermediate shaft (28) is a cylindrical, preferably smooth-cylindrical part, on which the driving gear wheel (30) and the toothed slaving shaft (32), the latter in particular comprising sintered metal, are seated, in particular being pressed, in a manner fixed against relative rotation and serve as an axial securing means for the wobble gear wheel (38), which is freely rotatable on the intermediate shaft (28), and for the driven gear wheel (35).

3. The drill hammer as defined by claim 1, characterized in that the toothed slaving shaft (32) matches the adjacent wobble gear wheel (38) and/or at least a partial region (68) of the driven gear wheel (35) in term of diameter and tooth profile.

4. The drill hammer as defined by claim 1, characterized in the shifting hubs (34, 134), which in particular are smooth-cylindrical on the outside and comprise sintered metal, have annular, groove-like slots (33, 133) on their outer circumference, for engagement of gearshift forks (52, 152) serving as a shifting means.

5. The drill hammer as defined by claim 4, characterized in that the gearshift forks (52, 152)—except in shifting operations—engage the slots (33, 133) in the shifting hubs (34, 134) without force, in particular in floating fashion and thus with low friction.

6. The drill hammer as defined by claim 1, characterized in that the shifting hubs (34, 134) have a plurality of tooth hub teeth, the toothed slaving shaft (32) has a plurality of tooth gaps, and a plurality of toothed shaft teeth (131) which on their side are oriented toward the wobble gear wheel (38) and/or the driven gear wheel (35), each of the toothed shaft teeth (131) has a partial tooth width reduction (62 for facilitating changeover and entry of the tooth hub teeth into the tooth gaps.

7. The drill hammer as defined by claim 1, characterized in that the shifting hubs (34, 134) have a plurality of teeth (69) which on their respective side are oriented toward the toothed slaving shaft (32), the teeth (69) have a partial tooth width reduction (70) for facilitating engaging the shifting hubs to the toothed slaving shaft.

8. The drill hammer as defined by claim 1, characterized in that between the motor (16) and the gear (26), an intermediate flange (25) is seated, in which one end of the intermediate shaft (28) is rotatably supported, in particular via a needle bearing.

9. The drill hammer as defined by claim 1, characterized in that a one-piece shift plate (54), in particular bent into the shape of a U, serves as a shifting means, and both legs (94, 96) of the U have a guide rod (51) passing through them as a linear guide, and one leg (94) of the U serves as a gearshift fork (52), while the other leg (96) of the U in particular forms a locking fork (56).

10. The drill hammer as defined by claim 1, characterized in that the wobble gear wheel (38), which has the wobble disk (40) and a wobble finger (42), is rotatably supported on the intermediate shaft (28) adjacent to the driving gear wheel (30), and the toothed slaving shaft (32) is seated coaxially adjacent to the wobble gear wheel in a manner fixed against relative rotation, on which toothed slaving shaft, axially adjacent, the driven gear wheel (35) is rotatably supported and axially secured by means of a roller bearing (45) seated fixedly on the end of the intermediate shaft (28).

11. The drill hammer as defined by claim 1, characterized in that at least one shift plate (54, 154) is provided, which engages a circumference of the shifting hub (34, 134) in form-locking fashion and is displaceable substantially parallel to the intermediate shaft (28).

* * * * *